United States Patent [19]

Diamond

[11] Patent Number: 4,629,120

[45] Date of Patent: Dec. 16, 1986

[54] FRONT-ADJUSTING, SELF-CLEANING ATOMIZER NOZZLE

[76] Inventor: Harvey E. Diamond, 12953 Woodbridge St., Studio City, Calif. 91604

[21] Appl. No.: 572,704

[22] Filed: Jan. 20, 1984

[51] Int. Cl.[4] ..... B05B 15/02

[52] U.S. Cl. ..... 239/117; 222/149; 137/244

[58] Field of Search ..... 239/123, 114, 115–118, 239/579–581; 222/148, 149; 251/121, 122, DIG. 4; 137/244, 245.5

[56] References Cited

U.S. PATENT DOCUMENTS

| | | | |
|---|---|---|---|
| 1,837,861 | 12/1931 | Green et al. | 239/117 |
| 3,250,474 | 5/1966 | McKernan | 239/117 |
| 3,361,301 | 1/1968 | Meshberg | 239/117 |
| 3,402,739 | 9/1968 | Kass | 251/121 |
| 3,625,005 | 3/1962 | Dafforn et al. | 239/117 |

*Primary Examiner*—Joseph F. Peters, Jr.

*Assistant Examiner*—Scott D. Malpede

*Attorney, Agent, or Firm*—Drucker & Sommers

[57] ABSTRACT

A fluid atomizer or "air mist" nozzle or valve of this invention has an elongated nozzle body provided with a frontal exit port, a needle valve coaxially moveable therein and normally biased against a spring means so that its outlet end is just upstream of the nozzle exit port. The nozzle body is connected to a source of both water and air, as in the prior art. In this invention, the needle valve outlet position is controlled, vis-a-vis the nozzle body exit port, from the front of the fluid nozzle by providing a frontal control means for moving the nozzle body with respect to a fixed-in-place needle valve. The frontal control means is provided with both a rotatable and an axial motion and comprises preferably a control knob or ring threadably engaging the nozzle body near the frontal end thereof. The control knob is, in turn, mounted within a fixed flange plate, having a rearwardly extending cylindrical bore, for slideable axial movement within said cylindrical bore.

16 Claims, 5 Drawing Figures

2
32
34
20
40
15
2
30

WATER
3
23
54
57

33
56
10
30
50
40
60
A
A
3
12
25
21
52
AIR 30
70
40
54
33a
37
60
56
62
57
46
16
17
20
15
14
44
35
A
A
12
20
12
25
52
33
41
31
34
32

FRONT-ADJUSTING, SELF-CLEANING ATOMIZER NOZZLE

FIELD OF THE INVENTION

This invention relates to self-cleaning, adjustable fluid nozzles, especially fluid valves having atomization capability.

BACKGROUND OF THE INVENTION

Atomizer fluid valves having self-cleaning capability are well known in the art. Such fluid atomizer or mist valves are made, for example, in the USA by Spraying Systems Co. (Model No. 11005).

As shown in the prior art drawings (FIGS. 4 and 5) such fluid nozzles, generally speaking, comprise an elongated nozzle body 200 having an exit orifice 202, a needle valve 204 coaxially mounted therein and normally biased against a spring means 206 so that its outlet end is just inward (upstream) of the nozzle exit orifice 202. The nozzle body 200 is connected to fluid source, e.g. water, and is also connected to an air supply. A cap member 220 having a mixing chamber 222 is retained at the end of nozzle body 200 by an internally threaded, knurled, nut 225. The needle valve outlet position is coaxially adjustable from the rear end of the fluid nozzle by pin 210, in relation to the nozzle exit orifice 202, and such adjustment affects the atomization pattern and rate of liquid flow. Further, this type of fluid nozzle is self-cleaning, by moving the needle valve 204, again from the rear, into the nozzle exit port 202 against the normal bias of the spring means 206. The movement of the needle valve with relation to the nozzle exit port is performed by turning a rear-mounted pin element 210 (e.g., by means of a screwdriver element) which in turn axially moves the needle valve (against its spring-loading) closer, or further, to the nozzle exit end 202.

Prior art atomizer valves, to the best of my knowledge, do not have any front cleaning and/or front adjustment capability. Such frontal adjustment and self cleaning is especially useful in fluid atomizer heads, or nozzles, intended for use by the general public.

SUMMARY OF THE INVENTION

A fluid atomizer or "air mist" nozzle or valve of this invention has an elongated nozzle body provided with a frontal exit port, a needle valve coaxially moveable therein and normally biased against a spring means so that its outlet end is just upstream of the nozzle exit port. The nozzle body is connected to a source of both water and air, as in the prior art.

In this invention, the needle valve outlet position is controlled, vis-a-vis the nozzle body exit port, from the front of the fluid nozzle by providing a frontal control means for moving the nozzle body with respect to a fixed-in-place needle valve.

The frontal control means is provided with both a rotatable and an axial motion and comprises preferably a control knob or ring threadably engaging the nozzle body near the frontal end thereof. The control knob is, in turn, mounted within a fixed flange plate, having a rearwardly extending cylindrical bore, for slideable axial movement within said cylindrical bore.

When the control knob is pushed towards the flange plate, the knob moves slideably axially inwardly carrying with it the threadably engaged nozzle body, since the needle valve is fixed. The exit port of the nozzle body will thus be moved towards the needle valve, until the needle tip extends into the nozzle exit port—for self-cleaning action of the nozzle exit port.

As the control knob is rotated, e.g. clockwise, the nozzle body is constrained for axial movement, in an incremental fashion, relative to the fixed needle valve. This movement is produced because of the threaded engagement of control knob to nozzle body, and because a second friction means is provided constraining movement of the control means to a linear, axial direction.

DETAILED DESCRIPTION OF THE INVENTION

Figure 4:
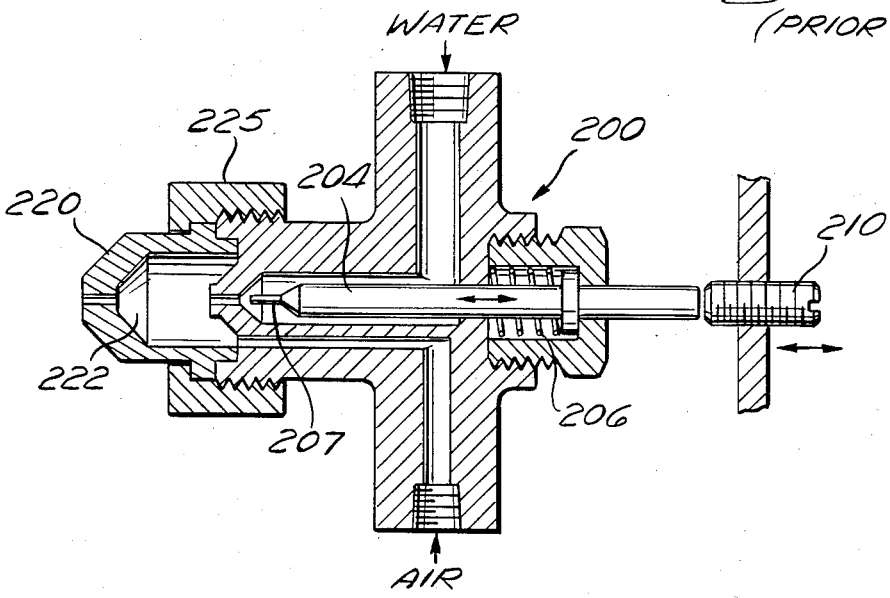
Fig. 4 (PRIOR ART)
FIG. 4 is a partial cross-sectional view of a prior art atomizer nozzle.
Figure 5:
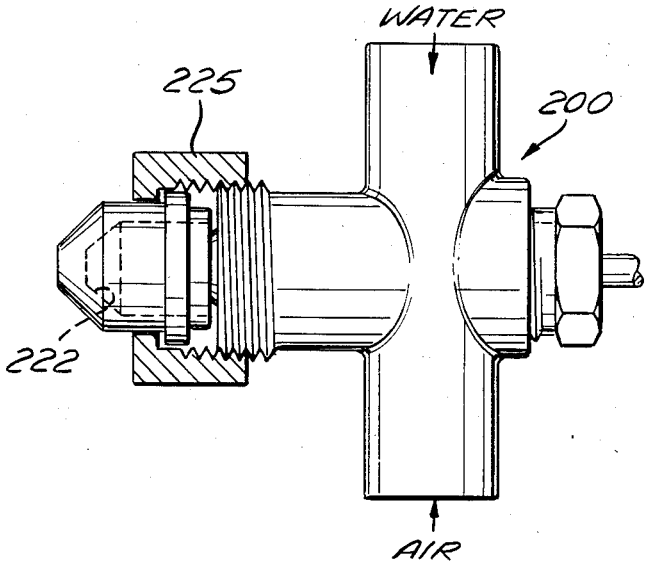
Fig. 5 (PRIOR ART)
FIG. 5 is a fragmentary, partially cross-sectional view of the atomizer nozzle of FIG. 5 showing the attachment of outlet nozzle cap member.

The invention herein will be described with reference to the modification of a conventional rear self-cleaning and rear-adjusting atomizer nozzle or valve, e.g., as shown in FIGS. 4 and 5 herein.

In the conventional atomizer nozzle (see FIGS. 4 and 5), the nozzle body 200 is fixed and the needle valve 204 is coaxially moved relative thereto by means of the axial movement of a slot-headed pin 210. In this manner, in the conventional atomizer head, the needle valve tip 207 is moved closer or further to the nozzle exit orifice 202 of the nozzle body 200, and, in this manner, the fluid flow ratios to the chamber 222 are changed, and the effluent atomizer flow pattern is also changed. Further, in the conventional atomizer head, the needle valve 204 may act as a self-cleaner by pushing the pin 210 downstream towards, and through, the nozzle exit orifice 202 (by exerting manual pressure on the pin 210 in the downstream direction). The needle valve 200 is spring-loaded by conventional means 206 and will return to its normal bias inwardly of the nozzle exit orifice 202 after the rearward manual pressure on pin 210 is released.

The conventional atomizer valve, just described, is modified to be a front-adjusting and front self-cleaning nozzle in the following manner.

Figure 2:
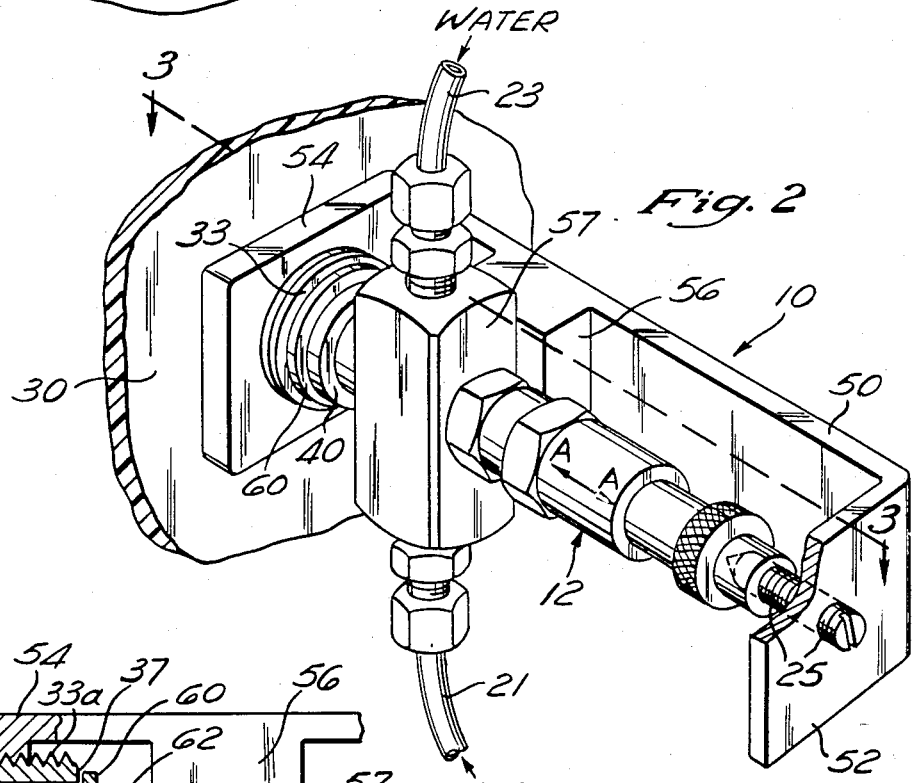
FIG. 2 is a perspective view of the entire atomizer nozzle of the invention, as viewed in the direction of arrows 2—2 of FIG. 1.
Figure 3:
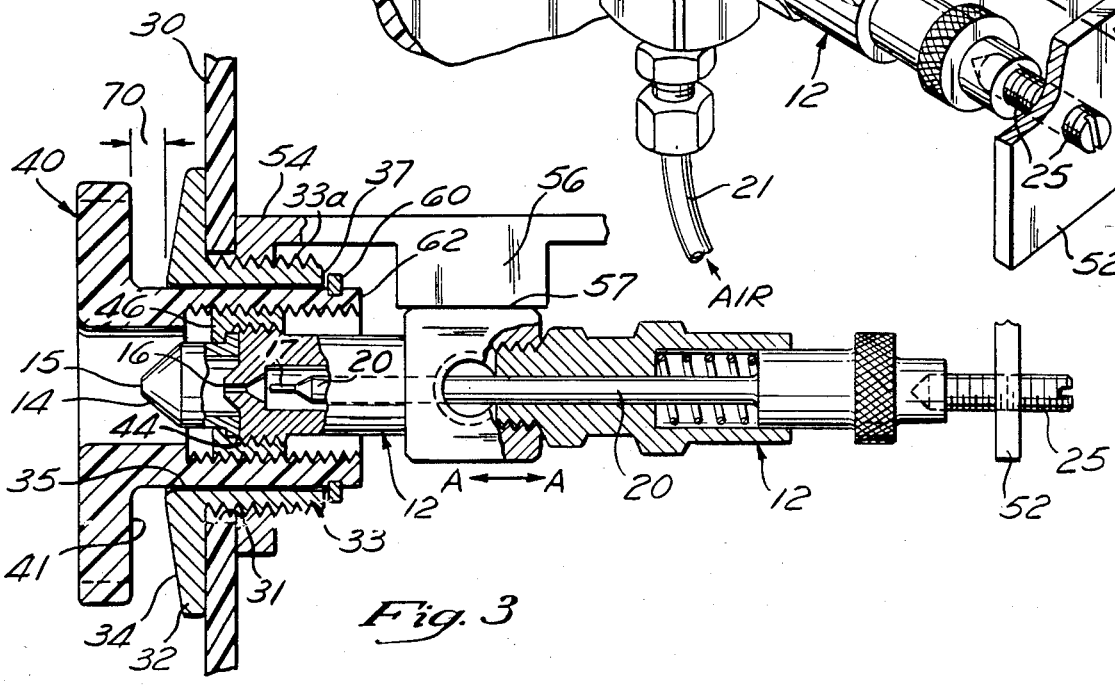
FIG. 3 is a cross-sectional view taken along the line 3—3 of FIG. 2.

The modifier atomizer nozzle 10 is best shown in FIGS. 2 and 3. An elongated nozzle body 12 is provided, having affixed thereto a cone-shaped exit end cap portion 14. The cap 14 is retained thereon by threaded retainer nut 46, as shown in the prior art drawings (FIGS. 4 and 5). The end cap portion 14 defines an exit orifice 15. The nozzle body 12 itself terminates in a nozzle exit orifice 16 (shown in dotted line). The nozzle body 12 houses a coaxially extending needle valve 20. The nozzle body 12 is connected to an air supply, via air hose 21, in a conventional manner. The nozzle body 12 is also connected to a source of water, under pressure, via line 23, by conventional means.

The modified valve 10 of this invention is preferably intended to be mounted behind a wall 30 of a shower or bathtub. The bathtub or shower wall may be made of a plastic or other suitable material.

The bathtub or shower wall 30 has an enlarged opening 31 formed therein through which is passed a cylindrical section 33 of a flange member 32 until the exterior flange plate 34 of flange member 32 abuts wall 30. Cylindrical section 33 is provided with external threads 33*a* for locking engagement to wall 30, by means of bracket arm 54, as will be described.

A frontal positional control knob means 40 is mounted for slideable movement through the cylindrical bore 35 of the cylindrical section 33 of flange member 32, the control knob means 40 being also in threadable engagement with externally threaded portion 44 affixed to the nozzle body 12 and cap member 14, by means of an internally and externally threaded lock nut 46. The lock nut 46 is frictionally engaged with, and held to, the cap member 14 and external threads 44 of the nozzle body 12 and therefore acts as an integral part of said nozzle body 12.

The rear end of the nozzle body 12 lies in engagement with pin 25. Pin 25 is fixed in place by means of a bracket 50, one arm 52 of which is clamped onto pin 25 and the other arm 54 of which fixes the bracket in place by means of threadable engagement to the externally threaded flange plate 32. Pin 25 (which functioned as a clean-out pin in the prior art, by moving needle valve 20 forward or rearward when pin 25 is rotated by a screwdriver blade or the like) now firmly retains needle valve 20 in place.

Bracket arm 54 serves as a lock nut to lock flange plate 34 to wall 30 as well as to retain pin 25 firmly in place. Bracket 50 also carries an integral block member 56, having a relatively large surface area, frictionally engaging transversely extending section 57 of the nozzle body 12. Block member 56 prevents nozzle body 12 from rotating as it is being moved by the control means 40, as will be further described.

Control knob member 40 is provided with a stop ring 60 at its inner end 62 to prevent disengagement of the control knob 40 outwardly from the wall 30.

The nozzle body 12 and retained cap 14 are spring-loaded by conventional means, such spring-loading of the nozzle body being indicated by arrows A—A in FIGS. 2 and 3.

The operation of the positional control means will now be described.

Figure 1:
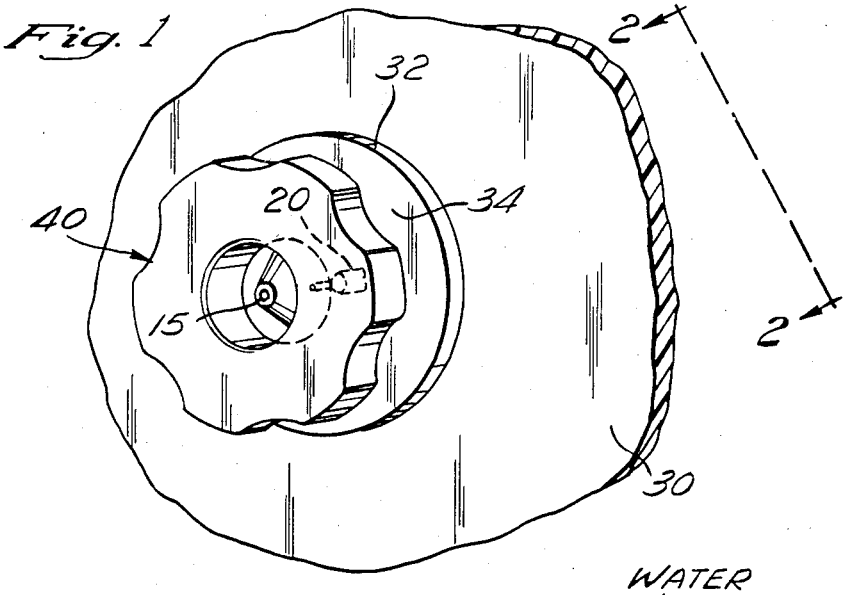
FIG. 1 is a fragmentary perspective view of the frontal section of the atomizer nozzle of the invention.

In the FIG. 3 position, the needle valve tip 17 and exit orifice 16 lie at their maximum distance from each other (because stop member 60 limits any further outward movement of nozzle body 12). In order to change the flow pattern, nozzle body exit orifice 16 is brought closer to needle valve tip 17 by rotating control knob 40 clockwise as viewed in FIG. 1. Such clockwise rotation causes rotation of cylindrical section 33 and incremental axial, linear movement of cap member 14 and nozzle body 12 inwardly. Rotational movement of cap 14 and nozzle body 12 is prevented by means of frictionally engaging block member 56 which acts as a follower in a track to limit the movement to one which is coaxial with the control means 40.

It is to be noted that, because needle valve 20 is fixed in place, inward axial movement of the nozzle body 12 decreases the distance between needle valve tip 17 and nozzle exit orifice 16 in a precise manner.

As seen in FIG. 3, a clearance 70 is provided between flange plate 32 and knob control means 40 when the stop ring or stop member 60 abuts the inner end of flange plate 34. By manually pushing inwardly on control means 40, the control means 40 is moved slideably inwardly within the bore 35 of flange cylindrical section 33, until the collar 41 of the control means 40 abuts the flange plate 34. In this maximum inward position, the needle tip 17 extends through nozzle orifice 16 to effect the self-cleaning action. Upon release of manual pressure on control means 40, such means 40 will immediately move outwardly under the influence of the spring-loaded nozzle body 12, until stop member 60 abuts the inner end 37 of cylindrical section 33.

It will be seen that a front self-cleaning and front adjusting atomization nozzle has been described, which is simple and precise in operation, and which can be utilized with existing nozzle designs with very minor retrofit requirements.

Modifications will be apparent to those skilled in the art. Hence, I intend to be bound only by the claims which follow.

I claim:

1. In an atomizer nozzle comprising a nozzle body having an exit orifice, a needle valve extending generally coaxially within said nozzle body and having its exit end proximate to the exit orifice of said nozzle body, said needle valve and nozzle body being mounted for relative movement with respect to each other, said nozzle body means being normally biased to a normal position by a biasing means wherein said needle valve is upstream of said exit orifice of said nozzle body, to effect atomization in said normally biased position, and having air and water inlet means in communication with said nozzle body and said needle valve respectively, the improvement which comprises:

a first means for fixing said needle valve in a predetermined position; and a positional control means provided adjacent the exit end of said nozzle body including:

a control knob means threadably engaged to said nozzle body, said control knob means, upon axially inward movement thereof, coaxially inwardly moving said nozzle body relative to said needle valve, against said biasing means, to a position wherein said needle valve extends into the exit orifice of said nozzle body for self-cleaning action;

said control knob means, upon rotation thereof, incrementally moving said nozzle body, against said biasing means, to a given predetermined, fixed position which is more proximate to, or distal from, said normal position with respect to said needle valve; and a second means for constraining rotational movement of said nozzle body during said incremental movement of said nozzle body caused by said rotation of said control knob means.

2. The atomizer nozzle of claim 1 further characterized by:

flange means on said positional control means limiting the maximum inward position of said positional control means.

3. The atomizer nozzle of claim 1 further characterized by:

said positional control means having an inner end, and stop means provided at said inner end of said positional control means.

4. The atomizer nozzle of claim 1 further characterized by:

said first means comprising a bracket means, one end of which is adapted to be fixedly positioned, and the other end of which is adapted to fix the position of said needle valve.

5. The atomizer nozzle of claim 1 further characterized by:

said first means being affixed to said second means for constraining movement of said nozzle body in an axial direction when under a torquing pressure.

6. The atomizer nozzle of claim 1 further characterized by:

said second means comprising a member having a relatively large surface area frictionally engaging said nozzle body.

7. The atomizer nozzle of claim 1 further characterized by:

a flange plate having a cylindrical bore, said positional control means being slideably moveable therein between predetermined inner and outer limits.

8. The atomizer nozzle of claim 1 further characterized by:

said positional control means having an inner end;

stop means provided at said inner end of said positional control means; and a flange plate having a cylindrical bore, said positional control means being slideably moveable therein between predetermined inner and outer limit, said inner and outer limits being determined by said flange plate and stop means, respectively.

9. The atomizer nozzle of claim 1 wherein said control knob means is threadably engaged to said nozzle body by means of threadable engagement with an externally threaded lock nut affixed near said exit end of said nozzle body.

10. The atomizer nozzle of claim 8 wherein said control knob means is threadably engaged to said nozzle body by means of threadable engagement with an externally threaded lock nut affixed near said exit end of said nozzle body.

11. The atomizer nozzle of claim 9 wherein said externally threaded lock nut is also internally threaded and threadably affixed to said nozzle body near said exit end thereof.

12. In an atomizer nozzle comprising a nozzle body having an exit orifice, a needle valve extending generally coaxially within said nozzle body and having its exit end proximate to the exit orifice of said nozzle body, said needle valve and nozzle body being mounted for relative movement with respect to each other, said nozzle body means being normally biased to a normal position by a biasing means wherein said needle valve is upstream of said exit orifice of said nozzle body, to effect atomization in said normally biased position, and having air and water inlet means in communication with said nozzle body and said needle valve respectively, the improvement which comprises:

a first means for fixing said needle valve in a predetermined position, said first means comprising a bracket means, one end of which is adapted to be fixedly positioned, and the other end of which is adapted to fix the position of said needle valve; and a positional control means provided adjacent the exit end of said nozzle body for:

coaxially moving said nozzle body relative to said needle valve, against said biasing means, to a position wherein said needle valve extends into the exit orifice of said nozzle body for self-cleaning action; and for incrementally moving said nozzle body, against said biasing means, to a given predetermined, fixed position which is more proximate to, or distal from, said normal position with respect to said needle valve.

13. In an atomizer nozzle comprising a nozzle body having an exit orifice, a needle valve extending generally coaxially within said nozzle body and having its exit end proximate to the exit orifice of said nozzle body, said needle valve and nozzle body being mounted for relative movement with respect to each other, said nozzle body means being normally biased to a normal position by a biasing means wherein said needle valve is upstream of said exit orifice of said nozzle body, to effect atomization in said normally biased position, and having air and water inlet means in communication with said nozzle body and said needle valve respectively, the improvement which comprises:

a first means for fixing said needle valve in a predetermined position, said first means including mean for constraining movement of said nozzle body in an axial direction when under a torquing pressure; and a positional control means provided adjacent the exit end of said nozzle body for:

coaxially moving said nozzle body relative to said needle valve, against said biasing means, to a position wherein said needle valve extends into the exit orifice of said nozzle body for self-cleaning action; and for incrementally moving said nozzle body, against said biasing means, to a given predetermined, fixed position which is more proximate to, or distal from, said normal position with respect to said needle valve.

14. In an atomizer nozzle comprising a nozzle body having an exit orifice, a needle valve extending generally coaxially within said nozzle body and having its exit end proximate to the exit orifice of said nozzle body, said needle valve and nozzle body being mounted for relative movement with respect to each other, said nozzle body means being normally biased to a normal position by a biasing means wherein said needle valve is upstream of said exit orifice of said nozzle body, to effect atomization in said normally biased position, and having air and water inlet means in communication with said nozzle body and said needle valve respectively, the improvement which comprises:

a first means for fixing said needle valve in a predetermined position;

a second means for constraining movement of said nozzle body in an axial direction when under a torquing pressure, said second means comprising a member having a relatively large surface area frictionally engaging said nozzle body; and a positional control means provided adjacent the exit end of said nozzle body for:

coaxially moving said nozzle body relative to said needle valve, against said biasing means, to a position wherein said needle valve extends into the exit orifice of said nozzle body for self-cleaning action; and for incrementally moving said nozzle body, against said biasing means, to a given predetermined, fixed position which is more proximate to, or distal from, said normal position with respect to said needle valve.

15. In an atomizer nozzle comprising a nozzle body having an exit orifice, a needle valve extending generally coaxially within said nozzle body and having its exit end proximate to the exit orifice of said nozzle body, said needle valve and nozzle body being mounted for relative movement with respect to each other, said nozzle body means being normally biased to a normal position by a biasing means wherein said needle valve is upstream of said exit orifice of said nozzle body, to effect atomization in said normally biased position, and having air and water inlet means in communication with said nozzle body and said needle valve respectively, the improvement which comprises:

a first means for fixing said needle valve in a predetermined position;

a positional control means provided adjacent the exit end of said nozzle body for:

coaxially moving said nozzle body relative to said needle valve, against said biasing means, to a position wherein said needle valve extends into the exit orifice of said nozzle body for self-cleaning action;

for incrementally moving said nozzle body, against said biasing means, to a given predetermined, fixed position which is more proximate to, or distal from, said normal position with respect to said needle valve; and a flange plate having a cylindrical bore, said positional control means being slideably moveable therein between predetermined inner and outer limits.

16. In an atomizer nozzle comprising a nozzle body having an exit orifice, a needle valve extending generally coaxially within said nozzle body and having its exit end proximate to the exit orifice of said nozzle body, said needle valve and nozzle body being mounted for relative movement with respect to each other, said nozzle body means being normally biased to a normal position by a biasing means wherein said needle valve is upstream of said exit orifice of said nozzle body, to effect atomization in said normally biased position, and having air and water inlet means in communication with said nozzle body and said needle valve respectively, the improvement which comprises:

a first means for fixing said needle valve in a predetermined position;

a positional control means, threadably mounted adjacent the exit end of said nozzle body, for:

coaxially moving said nozzle body relative to said needle valve, against said biasing means, to a position wherein said needle valve extends into the exit orifice of said nozzle body for self-cleaning action; and for incrementally moving said nozzle body, against said biasing means, to a given predetermined, fixed position which is more proximate to, or distal from, said normal position with respect to said needle valve;

a stop means provided at the inner end of said positional control means; and a flange plate having a cylindrical bore, said positional control means being slideably moveable therein between predetermined inner and outer limit, said inner and outer limits being determined by said flange plate and stop means, respectively.

* * * * *